US010665984B1

(12) United States Patent
Lee et al.

(10) Patent No.: US 10,665,984 B1
(45) Date of Patent: May 26, 2020

(54) ANTI-LOOSING CONNECTOR

(71) Applicants: KUNSHAN AMPHENOL ZHENGRI ELECTRONICS CO., LTD., Kunshan, Jiangsu Province (CN); Amphenol LTW Technology Co., Ltd., New Taipei (TW)

(72) Inventors: Chu-Hsueh Lee, New Taipei (TW); Chia-Nan Ho, New Taipei (TW)

(73) Assignees: KUNSHAN AMPHENOL ZHENGRI ELECTRONICS CO., LTD., Kunshan, Jiangsu Province (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/438,448

(22) Filed: Jun. 11, 2019

(30) Foreign Application Priority Data

May 2, 2019 (TW) ..... 108115275 A

(51) Int. Cl.

| | |
|---|---|
| ***H01R 4/38*** | (2006.01) |
| ***H01R 13/533*** | (2006.01) |
| ***H01R 13/631*** | (2006.01) |
| ***H01R 13/622*** | (2006.01) |

(52) U.S. Cl.
CPC ..... *H01R 13/533* (2013.01); *H01R 13/622* (2013.01); *H01R 13/631* (2013.01)

(58) Field of Classification Search
CPC ... H01R 13/533; H01R 13/622; H01R 13/631
USPC ..... 439/321
See application file for complete search history.

(56) References Cited

U.S. PATENT DOCUMENTS 1,747,082 A * 2/1930 Reuter et al. ..... F16B 39/36 411/265
2018/0261962 A1* 9/2018 Liu ..... H01R 24/564

FOREIGN PATENT DOCUMENTS

| | | | |
|---|---|---|---|
| DE | 4301503 | A1 | 10/1993 |
| DE | 10224000 | A1 | 12/2003 |
| DE | 202006015670 | U1 | 2/2008 |
| DE | 202015103479 | U1 | 8/2015 |

OTHER PUBLICATIONS

Search Report dated Jan. 3, 2020 of the corresponding European patent application No. EP19182217.0.

* cited by examiner

*Primary Examiner* — Jean F Duverne
(74) *Attorney, Agent, or Firm* — Chun-Ming Shih; HDLS IPR Services

(57) ABSTRACT

An anti-loosing connector for coupling with a corresponding connector has a tubular body, a nut sleeve and an elastic clamping ring. A plurality of terminals is arranged in the tubular body. The tubular body is inserted in the nut sleeve, and a thread for screwing the corresponding connector is arranged on the nut sleeve. The elastic clamping ring surrounding the nut sleeve is disposed between the tubular body and the nut sleeve. A polygonal annular surface is defined on one of the tubular body and the nut sleeve, the elastic clamping ring is fixed with the other of the tubular body and the nut sleeve, and the polygonal annular surface is pressed by the elastic clamping ring. A multi-step stopper for the elastic clamping ring is provided by the polygonal annular surface, and the tubular body and the nut sleeve are thereby prevented from relatively rotational looseness.

10 Claims, 10 Drawing Sheets

ANTI-LOOSING CONNECTOR

TECHNICAL FIELD

The present disclosure is related to a connector, and in particular to a screw fixed anti-loosing connector.

BACKGROUND

In general, in a static operation, connectors coupled with each other are fastened by a friction therebetween and thereby prevented from looseness. Under a dynamic operation or a frequently vibrating operation, it is not enough to prevent the connectors coupled with each other from looseness by only the friction therebetween. Therefore, a nut and a thread are commonly used for screwing the connectors to further avoid looseness.

However, in certain operation, relative rotation between the two connectors might be required, or extremely frequent vibrations occur, those may gradually cause relatively rotational looseness between the nut and thread.

In views of this, in order to solve the above disadvantage, the present inventor studied related technology and provided a reasonable and effective solution in the present disclosure.

SUMMARY

A screw fixed anti-loosing connector is provided in the present disclosure.

An anti-loosing connector for coupling with a corresponding connector is provided in the present disclosure, the anti-loosing connector has a tubular body, a nut sleeve and an elastic clamping ring. A plurality of terminals is arranged in the tubular body. The tubular body is inserted in the nut sleeve, and a thread for screwing the corresponding connector is arranged on the nut sleeve. The elastic clamping ring surrounding the nut sleeve is disposed between the tubular body and the nut sleeve. A polygonal annular surface is defined on one of the tubular body and the nut sleeve, the elastic clamping ring is fixed with the other of the tubular body and the nut sleeve, and the polygonal annular surface is pressed by the elastic clamping ring.

According to the anti-loosing connector of the present disclosure, the polygonal annular surface is defined on an external surface of the tubular body, the polygonal annular surface comprises a plurality of sub-planes circularly arranged, the elastic clamping ring is fixed with the nut sleeve, and an internal periphery of the elastic clamping ring presses on at least one of the sub-planes. A straight segment is formed on the elastic clamping ring, and the straight segment presses on one of the sub-planes.

According to the anti-loosing connector of the present disclosure, the polygonal annular surface is defined on an internal surface of the nut sleeve, the polygonal annular surface comprises a plurality of sub-planes annularly arranged, the elastic clamping ring is fixed with the tubular body and an external periphery of the elastic clamping ring presses on at least a junction between two of the sub-planes adjacent to each other. the elastic clamping ring is bent to form an external protrusion, and an external periphery of the external protrusion presses on the junction between two of the sub-planes adjacent to each other.

According to the anti-loosing connector of the present disclosure, the thread is defined on an external surface of the nut sleeve.

According to the anti-loosing connector of the present disclosure, two ends of the nut sleeve are respectively a screwing end and an operating end the thread is disposed on the screwing end, a handle sleeve is connected to the operating end and the nut sleeve and the handle sleeve are coaxially and rotatable relative to each other. the operating end and the handle sleeve are telescoped with each other.

According to the anti-loosing connector of the present disclosure, stopping rings are respectively arranged on two ends of the tubular body, one of the stopping rings is arranged at outside of the screwing end for stopping, and the other stopping ring is fixed in the handle sleeve. The stopping ring is formed on the external surface of the tubular body or the stopping ring clamps on the external surface of the tubular body.

The anti-loosing connector according to the present disclosure further has a terminal seat, the terminal seat comprises a main body and a plurality of columns parallel with each other and extended from the main body, each terminal is embedded in the main body and extended to longitudinally protrude from an end of the corresponding column, a plurality of channels corresponding to the columns is defined in the tubular body, the main body is accommodated in the handle sleeve, the respective columns are inserted in the respective corresponding channels and the respective terminals are exposed in the tubular body.

According to the anti-loosing connector of the present disclosure, the nut sleeve and the tubular body are fastened by pressing the polygonal annular surface by the elastic clamping ring. A multi-step stopper for the elastic clamping ring is provided by the polygonal annular surface, and the tubular body and the nut sleeve are thereby prevented from relatively rotational looseness.

BRIEF DESCRIPTION OF DRAWINGS

The present disclosure can be more fully understood by reading the following detailed description of the embodiment, with reference made to the accompanying draw.

DETAILED DESCRIPTION

Figure 1:
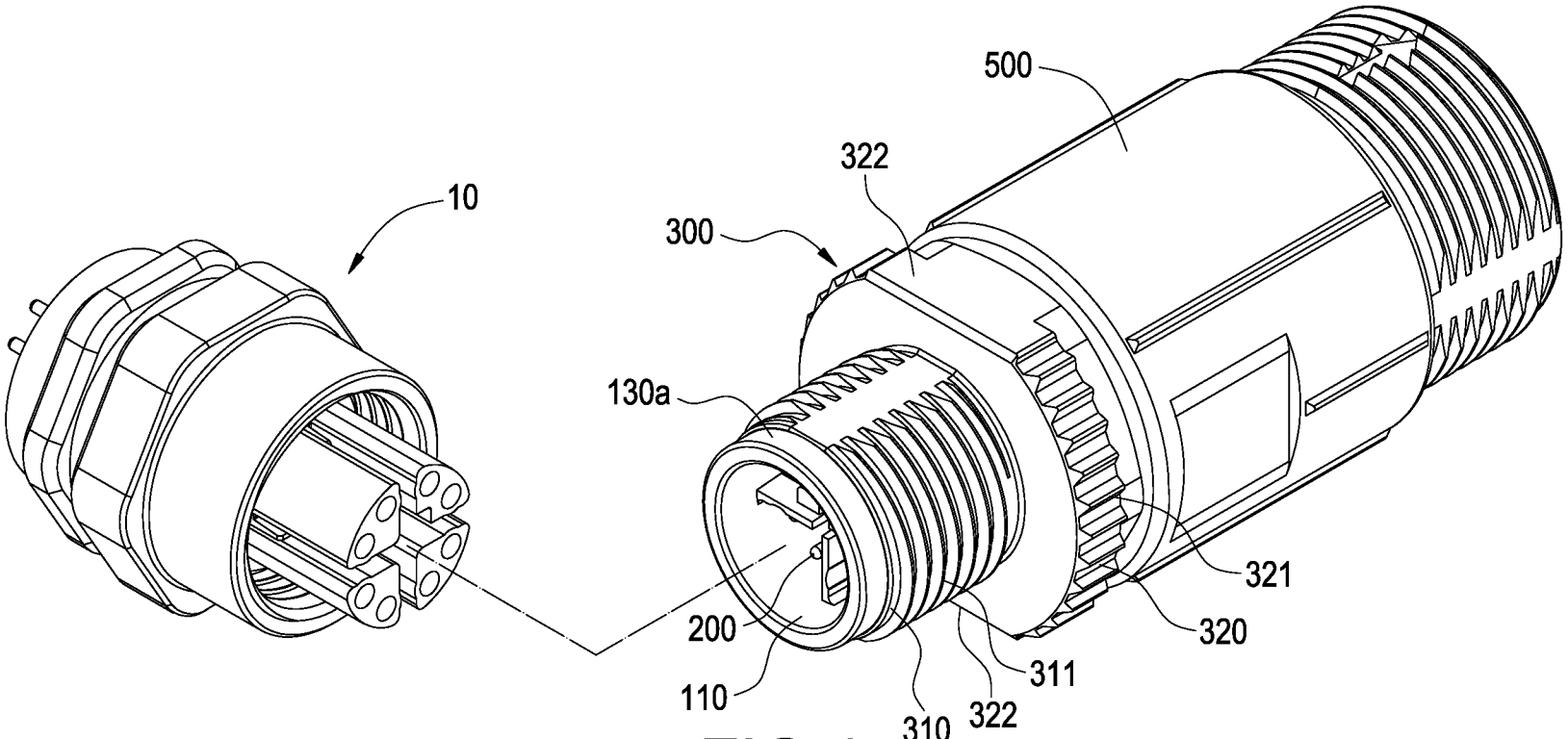
FIGS. 1 and 2 are schematic views showing the anti-loosing connector in use according to the first embodiment of the present disclosure.
Figure 2:
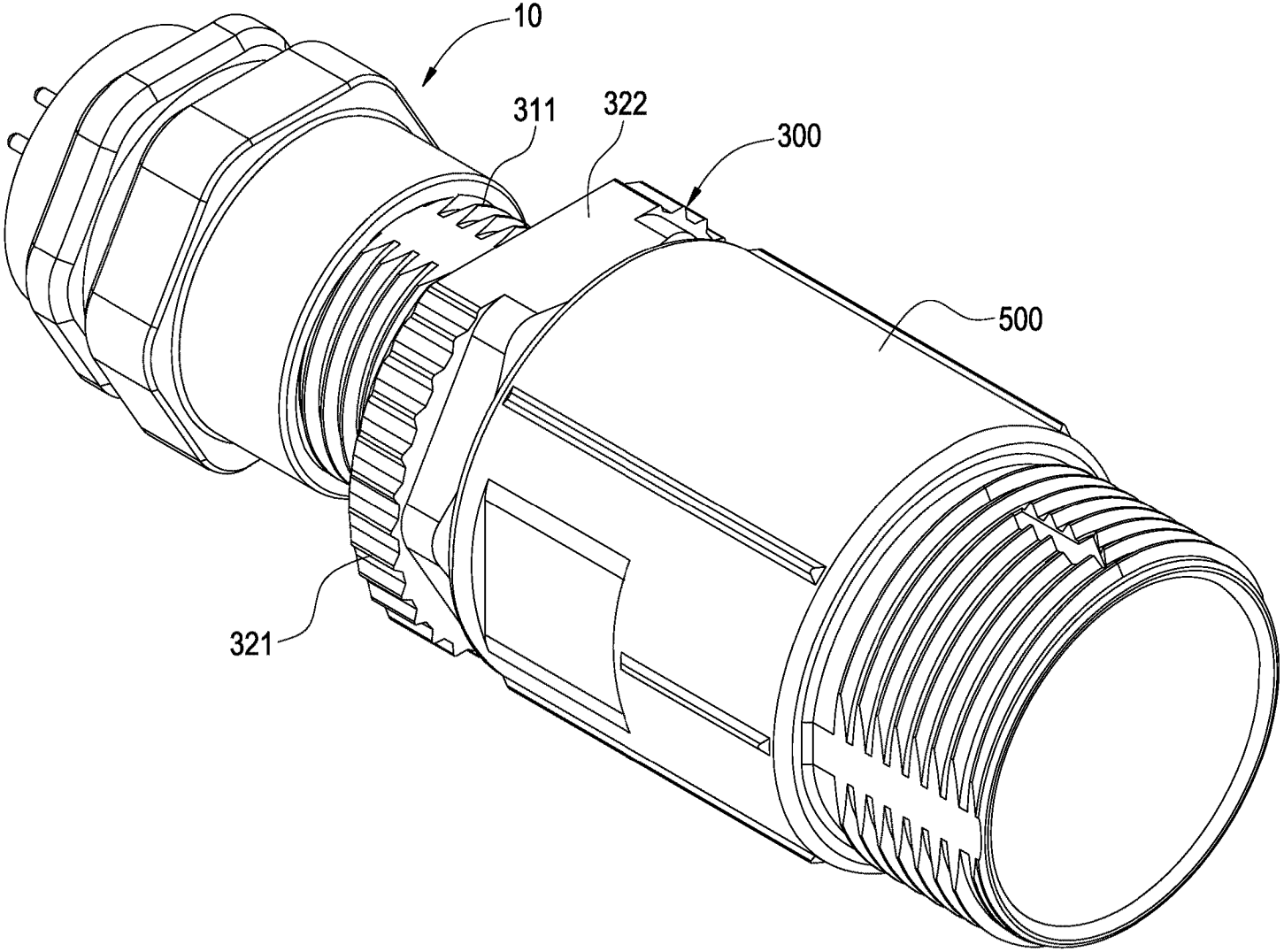

According to the first embodiment of the present disclosure shown in FIGS. 1 to 5, an anti-loosing connector for coupling with a corresponding connector 10 is provided. The anti-loosing connector has a tubular body 100, a plurality of terminals 200, a nut sleeve 300, an elastic clamping ring 410, a handle sleeve 500 and a terminal seat 600.

According to the present embodiment, the tubular body 100 is preferably insulative and could be conductive alternatively. A plurality of channels 101 is defined in the tubular body 100. The respective terminals 200 are metal pins and the respective terminals 200 are inserted in the respective channels 101. Specifically, two ends of the tubular body 100 are respectively an outer end 110 and an inner end 120, and the respective channels 101 are parallel with a longitudinal direction of the tubular body 100 and communicated between outer end 110 and the inner end 120 of the tubular body 100.

Figure 3:
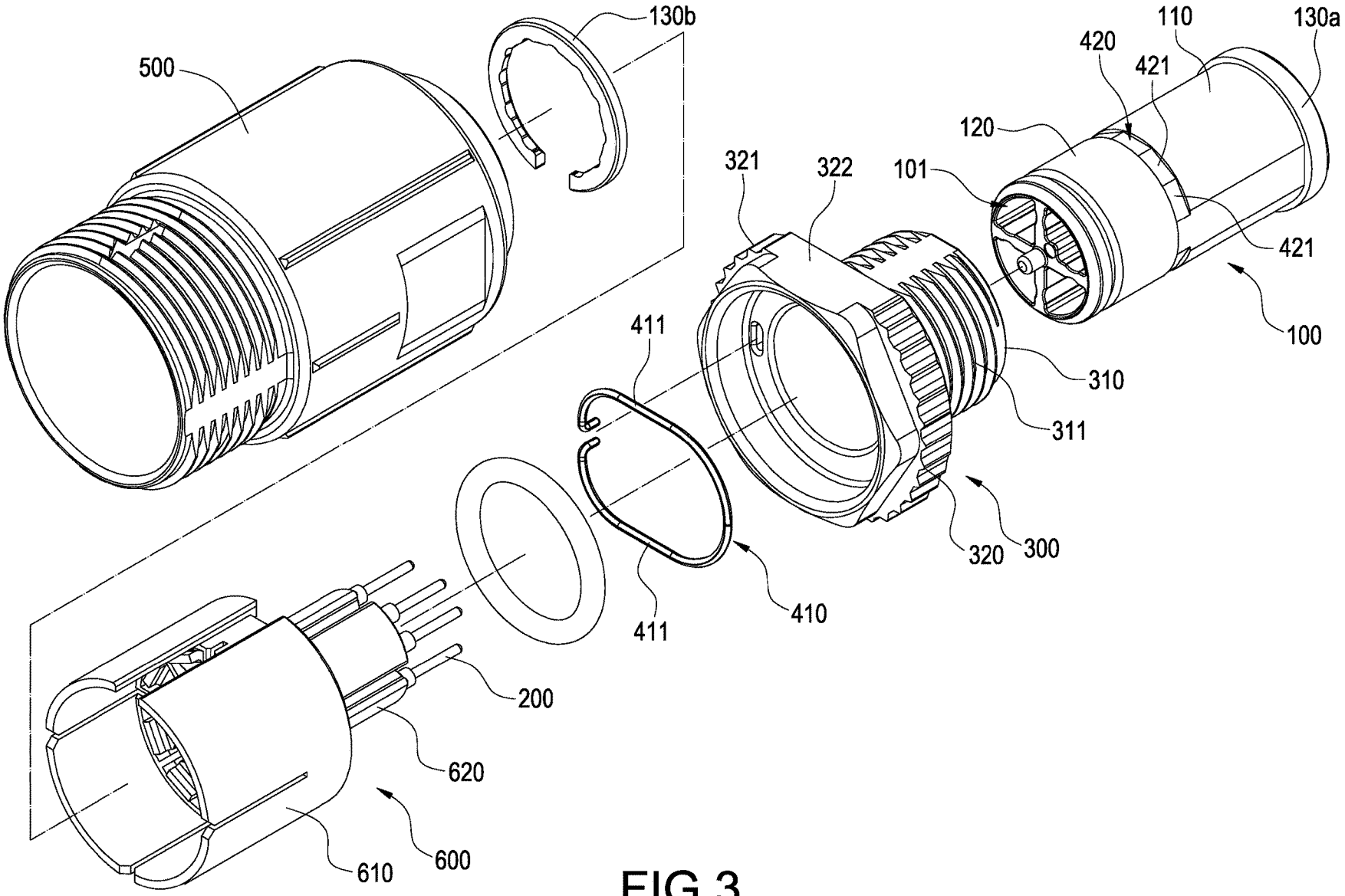
FIG. 3 is an exploded view showing the anti-loosing connector according to the first embodiment of the present disclosure.
Figure 6:
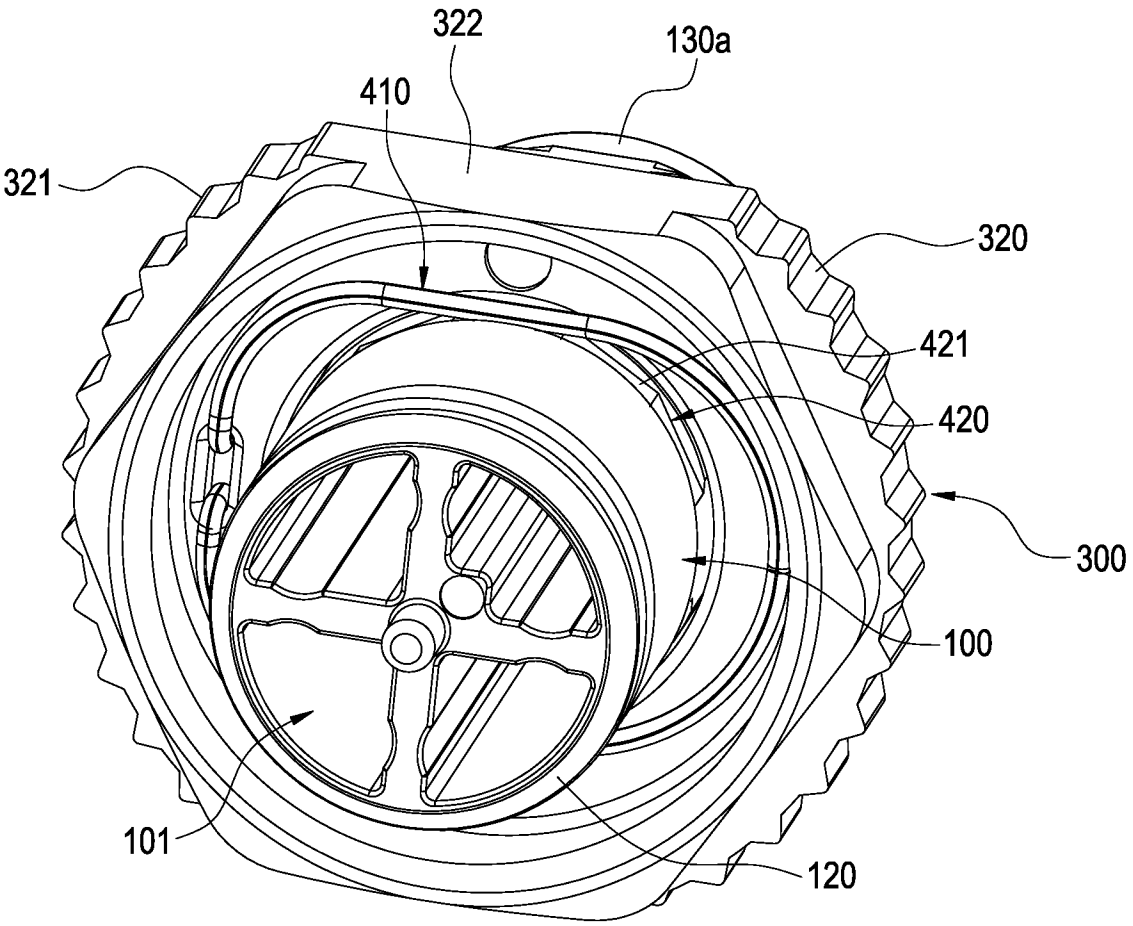
FIG. 6 is a schematic view showing the tubular body telescoped with the nut sleeve according to the first embodiment of the present disclosure.

According to FIGS. 3 and 6, the nut sleeve 300 sleeves on the tubular body 100, two ends of the nut sleeve 300 are respectively a screwing end 310 and an operating end 320, the outer end 110 of the tubular body 100 is inserted in the screwing end 310 of the nut sleeve 300, and the inner end 120 of the tubular body 100 is inserted in the operating end 320 of the nut sleeve 300. a thread 311 is defined on the screwing end 310 of the nut sleeve 300 for screwing with the corresponding connector 10. According to the present disclosure, the thread 311 is preferably defined on an external surface of the screwing end 310, but the thread 311 could be alternatively defined on an internal surface of the screwing end 310 corresponding to various corresponding connector 10.

According to FIGS. 1 to 5, the operating end 320 of the nut sleeve 300 is connected to the handle sleeve 500 and the nut sleeve 300 and the handle sleeve 500 are coaxially rotatable relative to each other. Specifically, the operating end 320 and the handle sleeve 500 are telescoped with each other. A friction rib 321 for manually operation or a clamping plane 322 for being clamped by tool could be defined on an external surface of the operating end 320, and a couple of clamping planes 322 parallel with each other are preferably provided. Therefore, a user could hold the handle sleeve 500 and rotate the operating end of the nut sleeve 300 manually or by a tool such as a spanner to rotate the nut sleeve 300. Thereby, the thread 311 could be screwed into or out from the corresponding connector 10.

Figure 4:
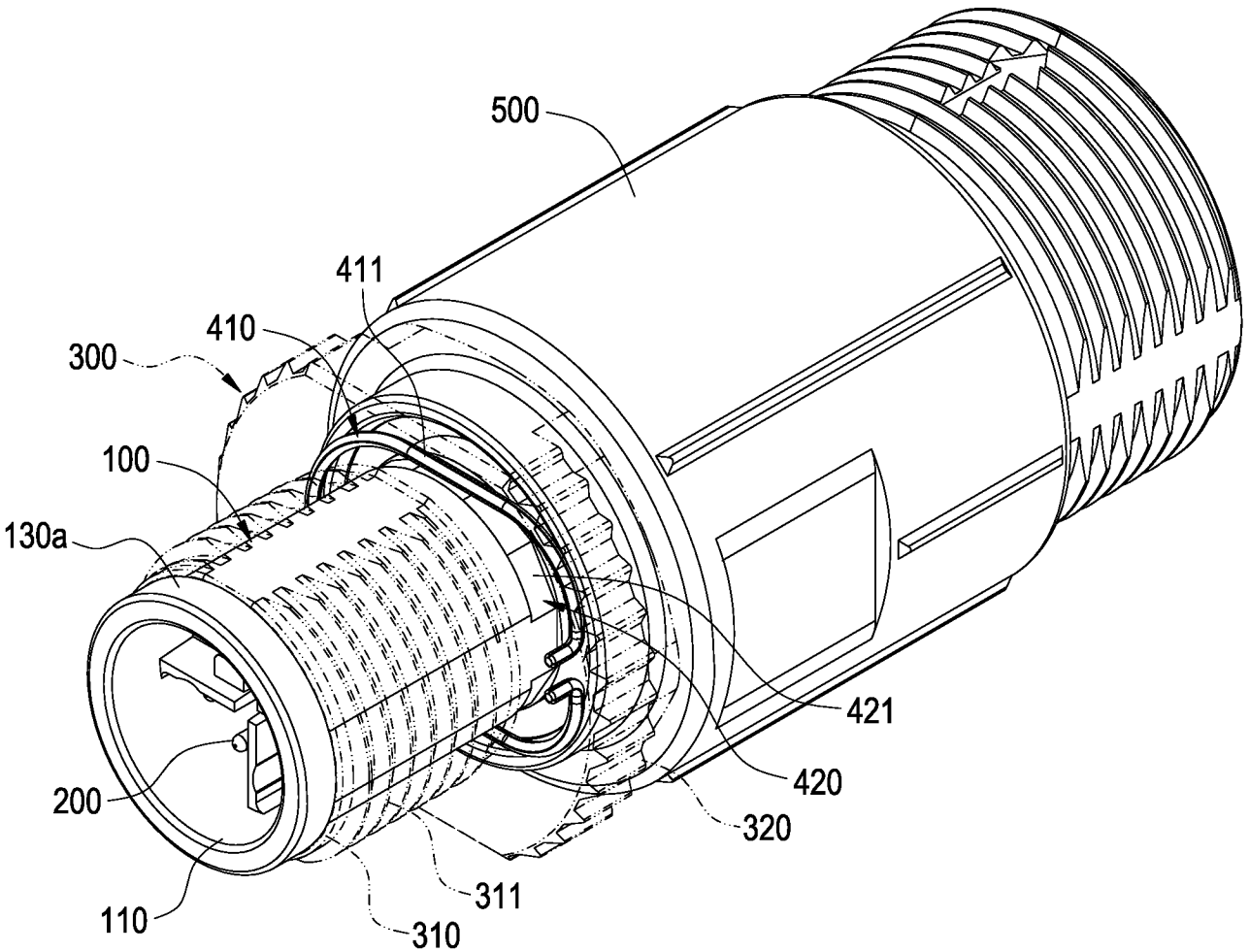
FIGS. 4 and 5 are perspective views showing the anti-loosing connector according to the first embodiment of the present disclosure.
Figure 5:
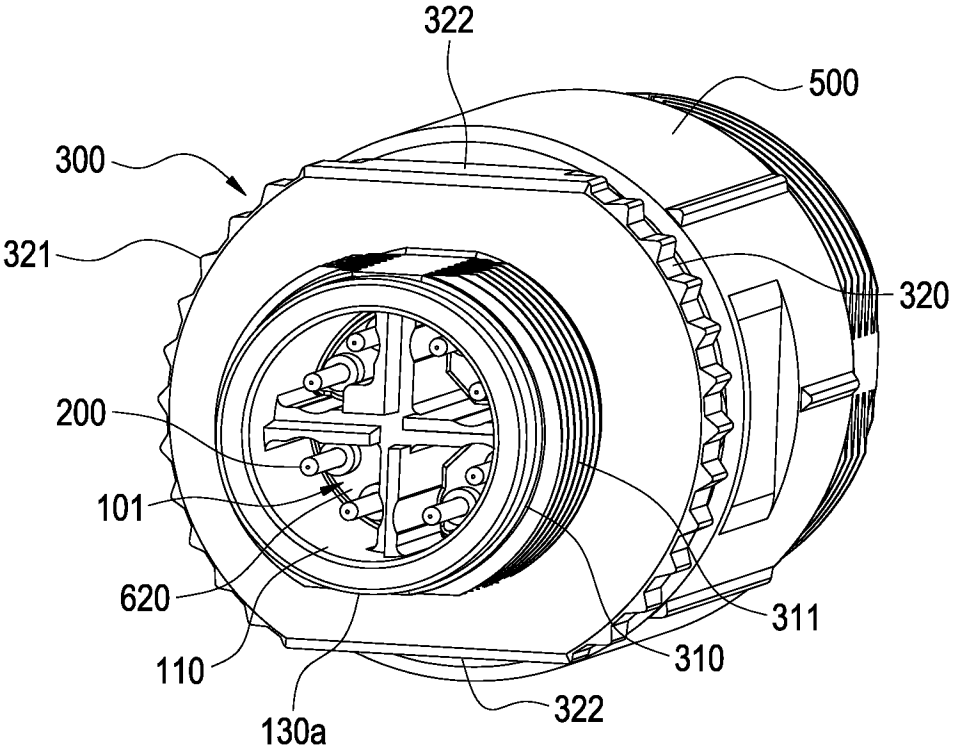

According to FIGS. 3 to 5, the terminal seat 600 has a main body 610, the main body 610 is preferably a cylinder, and a plurality of columns 620 is extended from an end of the main body 610 along a longitudinal direction of the main body 610. The main body 610 of the terminal seat 600 is accommodated in the handle sleeve 500, the respective columns 620 are arranged corresponding to the respective channels 101 of the tubular body 100, and the columns 620 are thereby arranged at interval. The terminals 200 are embedded in the main body 610 and extended along the longitudinal direction of the main body 610 to protrude from an end of the corresponding column 620. The respective columns 620 are inserted in the respective corresponding channels 101, and the respective columns 620 are inserted into the respective channels 101 through the tubular body 100, and the respective terminals 200 are thereby exposed in the outer end 110 of the tubular body 100.

According to FIG. 3, a polygonal annular surface 420 is defined on one of the tubular body 100 and the nut sleeve 300. According to the present embodiment, the polygonal annular surface 420 is an external annular surface defined on an external surface of the tubular body 100, and the polygonal annular surface 420 has a plurality of sub-planes 421 annularly arranged.

Figure 7:
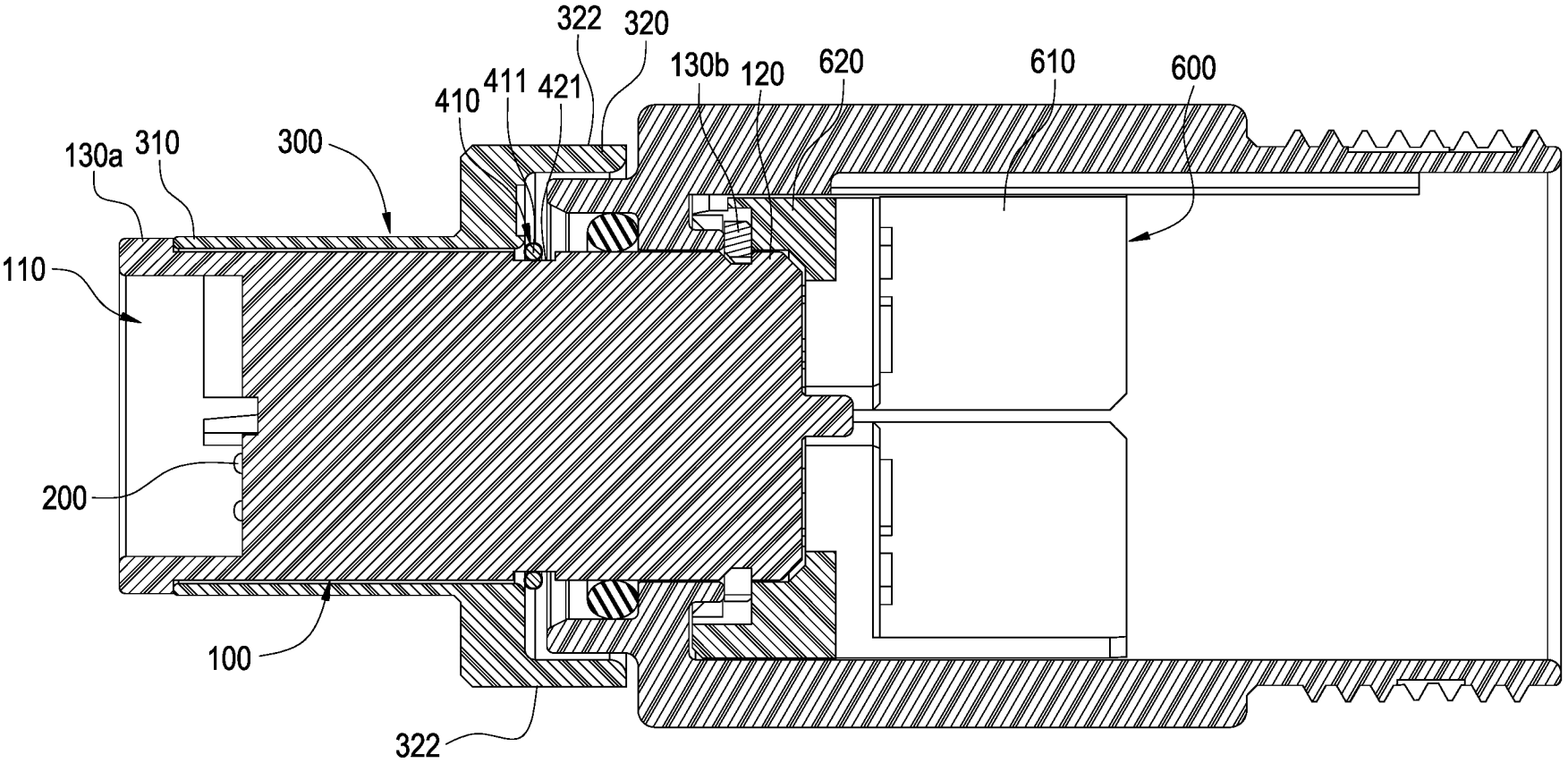
FIGS. 7 and 8 are longitudinal cross-sectional views showing the anti-loosing connector according to the second embodiment of the present disclosure.
Figure 8:
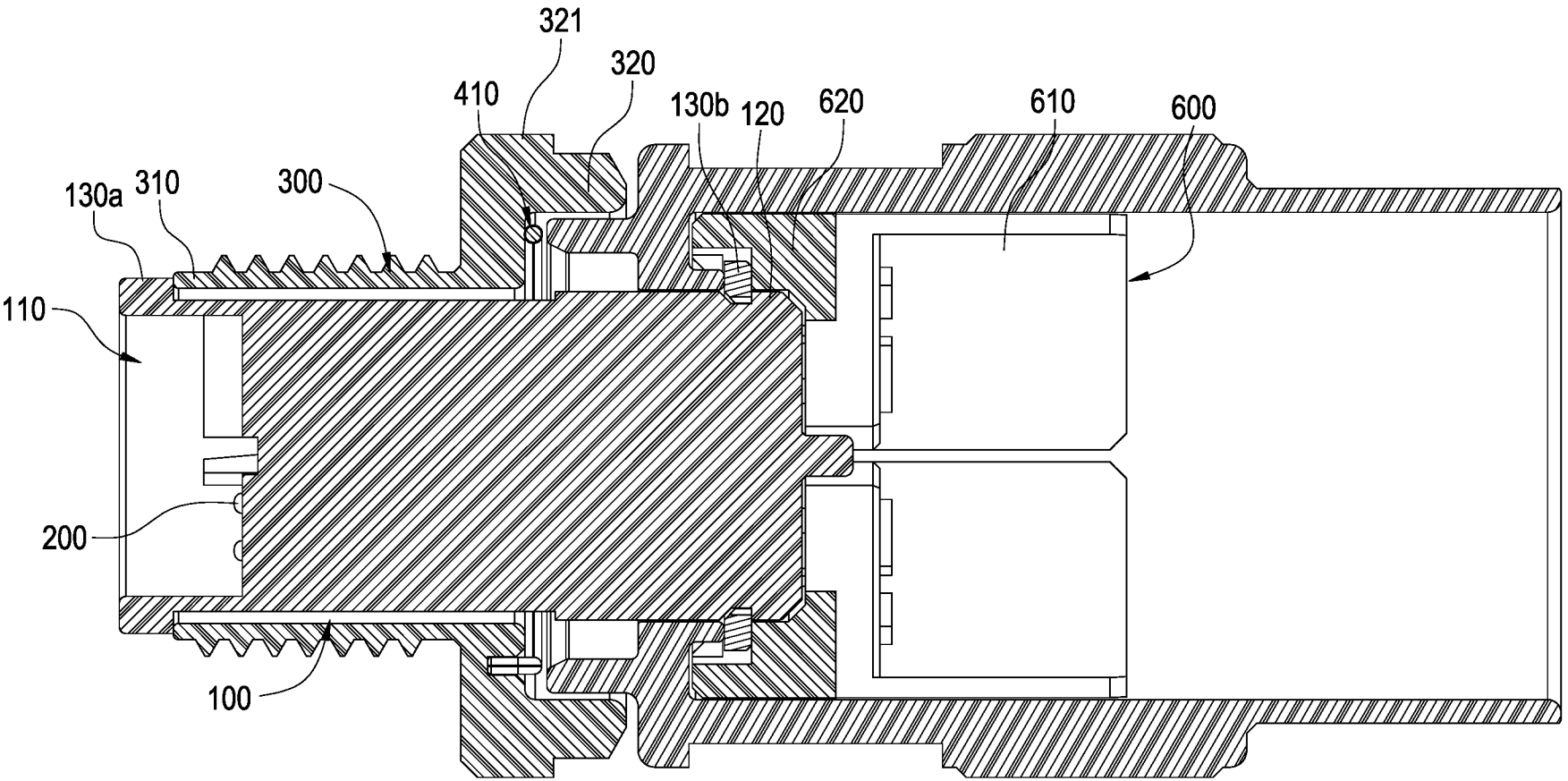
Figure 9:
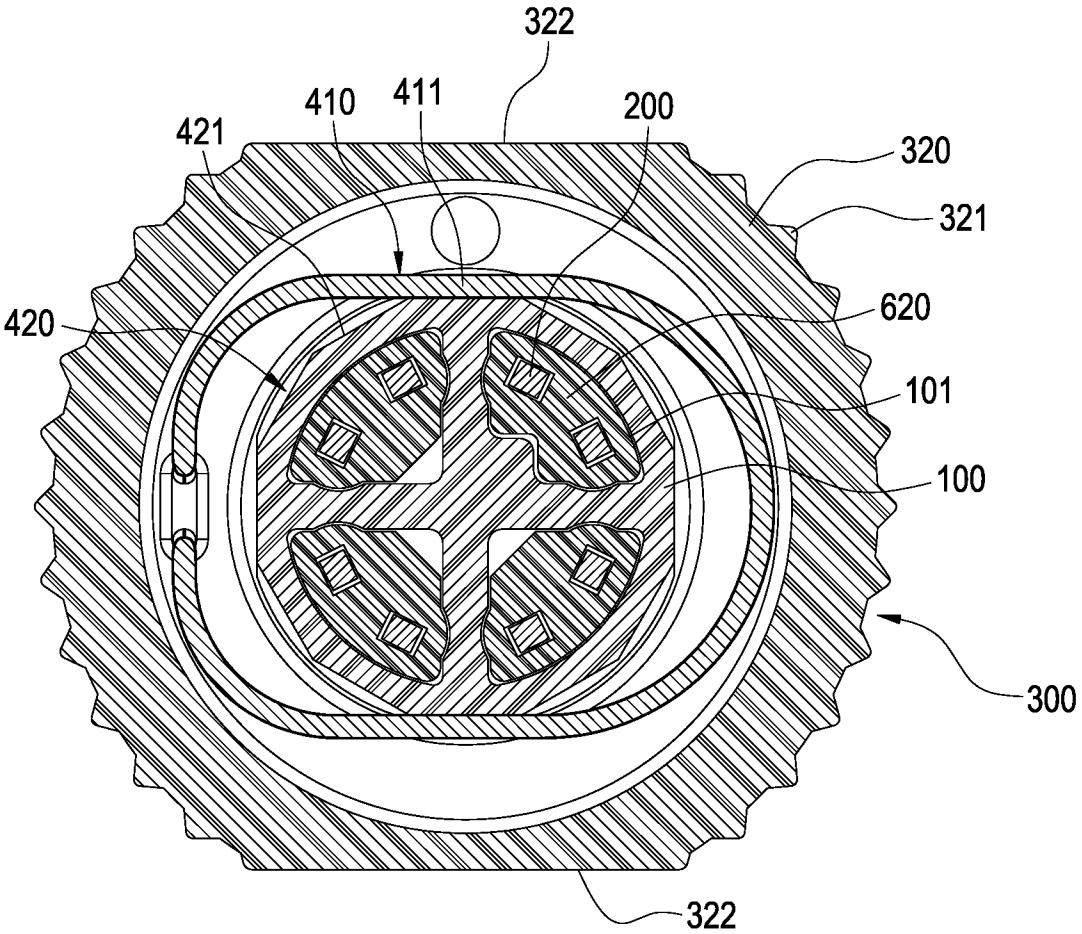
FIG. 9 is a cross-sectional view showing the anti-loosing connector according to the second embodiment of the present disclosure.

According to FIGS. 7 to 9, the elastic clamping ring 410 is arranged surrounding the nut sleeve 300 and the elastic clamping ring 410 is arranged between the tubular body 100 and the nut sleeve 300. The elastic clamping ring 410 is fixed to the other of the tubular body 100 and the nut sleeve 300, and the polygonal annular surface 420 is pressed by the elastic clamping ring 410. According to the present embodiment, specifically, the elastic clamping ring 410 is a C clip formed by a bent metal wire, two ends of the elastic clamping ring 410 are respectively fixed on an internal surface of the nut sleeve 300, and a straight segment 411 is formed on at least a portion of the elastic clamping ring 410. According to the present embodiment, a couple of same straight segments 411 parallel with each other are preferably formed on the elastic clamping ring 410. However, number and position of the straight segment 411 should not be limited in the present disclosure. Furthermore, an internal periphery of the elastic clamping ring 410 pressed on at least one of the sub-planes 421, and the internal peripheries of the couple of straight segments 411 are respectively presses on a couple of opposite sub-plane 421 according to the present embodiment. Thereby, the tubular body 100 is clamped by the elastic clamping ring 410 and is therefore un-rotatable relative to the nut sleeve 300.

According to the anti-loosing connector of the present disclosure, a stopping ring 130*a*/130*b* is arranged on each end of the tubular body 100. One of the stopping rings 130*a* is formed on the external surface of the outer end 110 of the tubular body 100 for stopping at outside of the screwing end 310 of the nut sleeve 300. The other stopping ring 130*b* clamps on the external surface of the inner end 120 of the tubular body 100 and fixed in the handle sleeve 500. Thereby the tubular body 100 is fixed with the handle sleeve 500.

When the anti-loosing connector of the present disclosure is impacted or shocked and the nut sleeve 300 and the tubular body 100 are relatively rotated, the straight segments 411 of the elastic clamping ring 410 therefore slip off the pressed sub-plane 421. The elastic clamping ring 410 is further rotated with the nut sleeve 300 relative to the tubular body 100, and each straight segment 411 is shifted to press on another adjacent sub-plane 421 and the tubular body is fixed with nut sleeve 300 again. Thereby, the nut sleeve 300 is prevented from further rotation relative to the corresponding connector 10 and prevented from looseness.

Figure 10:
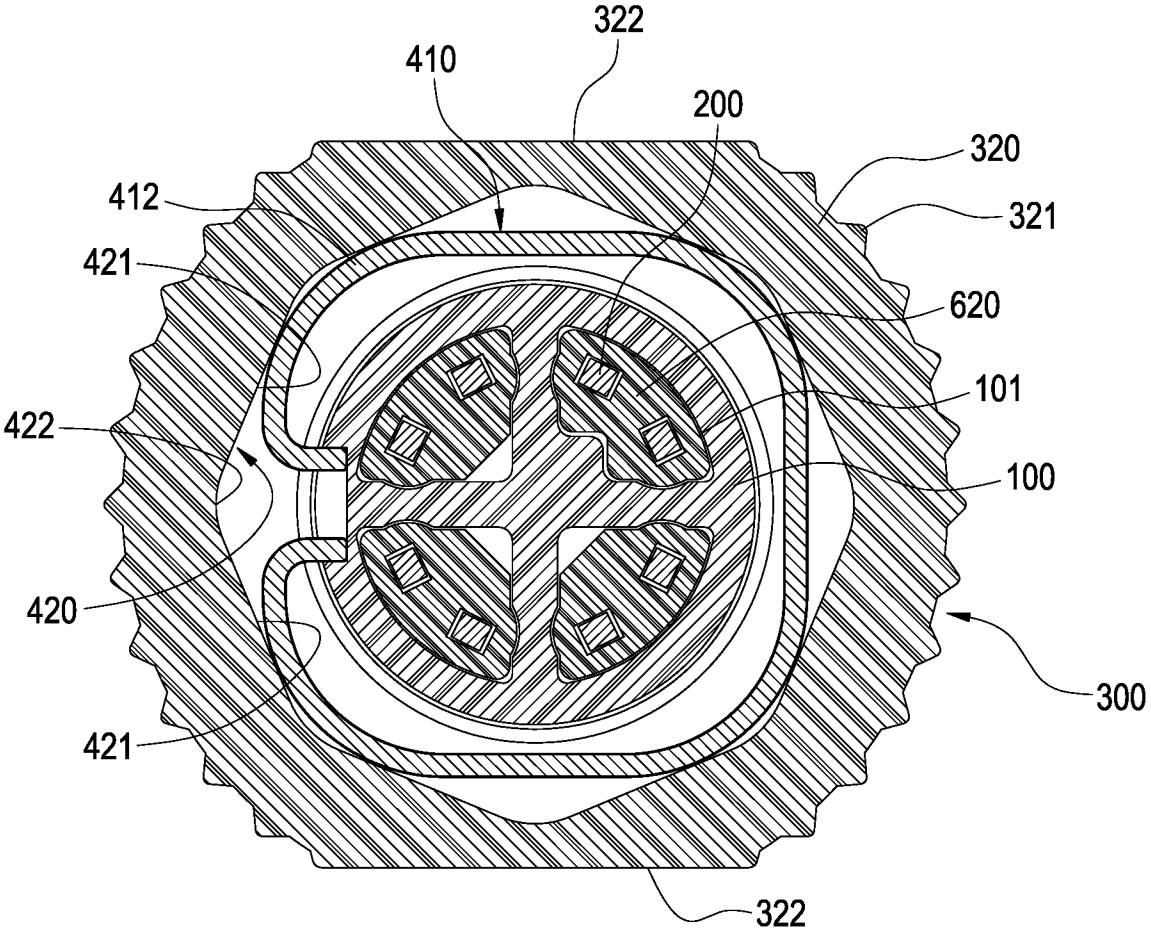
FIG. 10 is a schematic view showing the anti-loosing connector according to the second embodiment of the present disclosure.

According to the second embodiment shown in FIG. 10, an anti-loosing connector mostly the same as the aforementioned first embodiment is provided, and the same structure will not be repeated. The difference between the present embodiment and the first embodiment are described below. According to the present embodiment, the polygonal annular surface 420 is internal annular surface defined on the internal surface of the nut sleeve 300, the polygonal annular surface 420 has a plurality of sub-planes 421, and an internal corner 422 is formed between any two adjacent sub-planes 421. The elastic clamping ring 410 is a C clip formed by a bent metal wire, two ends of the elastic clamping ring 410 are respectively fixed on the external surface of the tubular body 100, the elastic clamping ring 410 is bent to form an external protrusion 412, and a periphery of external protrusion 412 could press on any of the internal corners 422 and the tubular body 100 is thereby fixed with the nut sleeve 300. When the anti-loosing connector of the present disclosure is impacted or shocked and the nut sleeve 300 and the tubular body 100 are relatively rotated, the external protrusion 412 of the elastic clamping ring 410 therefore slip off the pressed internal corner 422. The elastic clamping ring 410 is further rotated with the nut sleeve 300 relative to the tubular body 100, and each external protrusion 412 is shifted into another adjacent internal corner 422 and the tubular body is fixed with nut sleeve 300 again. Thereby, the nut sleeve 300 is prevented from further rotation relative to the corresponding connector 10 and prevented from looseness.

According to the anti-loosing connector of the present disclosure, the nut sleeve 300 and the tubular body 100 are fixed by the elastic clamping ring 410 pressing on the polygonal annular surface 420. A multi-step stopper for the elastic clamping ring 410 is provided by the polygonal annular surface 420. When the nut sleeve 300 and tubular body 100 are loosened and therefore relatively rotated, the elastic clamping ring 410 could immediately latch into the next pressed point and the nut sleeve 300 and tubular body 100 are fixed again. Thereby, the nut sleeve 300 is prevented from further rotation relative to the corresponding connector 10 and prevented from looseness.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. An anti-loosing connector for coupling with a corresponding connector, the anti-loosing connector comprising:

a tubular body, a plurality of terminals being inserted in the tubular body;

a nut sleeve sleeving on the tubular body, and a thread being defined on the nut sleeve for correspondingly screwed with the corresponding connector; and an elastic clamping ring surrounding the nut sleeve and arranged between the tubular body and the nut sleeve, wherein a polygonal annular surface is defined on one of the tubular body and the nut sleeve, the elastic clamping ring is fixed with the other of the tubular body and the nut sleeve, and the polygonal annular surface is pressed by the elastic clamping ring, wherein two ends of the nut sleeve are respectively a screwing end and an operating end, the thread is disposed on the screwing end, a handle sleeve is connected to the operating end and the nut sleeve and the handle sleeve are coaxially and rotatable relative to each other;

wherein stopping rings are respectively arranged on two ends of the tubular body, one of the stopping rings is arranged at outside of the screwing end for stopping, and the other stopping ring is fixed in the handle sleeve.

2. The anti-loosing connector according to claim 1, wherein the polygonal annular surface is defined on an external surface of the tubular body, the polygonal annular surface comprises a plurality of sub-planes annularly arranged, the elastic clamping ring is fixed with the nut sleeve, and an internal periphery of the elastic clamping ring presses on at least one of the sub-planes.

3. The anti-loosing connector according to claim 2, wherein a straight segment is formed on the elastic clamping ring, and the straight segment presses on one of the sub-planes.

4. The anti-loosing connector according to claim 1, wherein the polygonal annular surface is defined on an internal surface of the nut sleeve, the polygonal annular surface comprises a plurality of sub-planes circularly arranged, the elastic clamping ring is fixed with the tubular body and an external periphery of the elastic clamping ring presses on at least a junction between two of the sub-planes adjacent to each other.

5. The anti-loosing connector according to claim 4, wherein the elastic clamping ring is bent to form an external protrusion, and an external periphery of the external protrusion presses on the junction between two of the sub-planes adjacent to each other.

6. The anti-loosing connector according to claim 1, wherein the thread is defined on an external surface of the nut sleeve.

7. The anti-loosing connector according to claim 1, wherein the operating end and the handle sleeve are telescoped with each other.

8. The anti-loosing connector according to claim 1, wherein the stopping ring is formed on an external surface of the tubular body.

9. The anti-loosing connector according to claim 1, wherein the stopping ring clamps on an external surface of the tubular body.

10. The anti-loosing connector according to claim 1, further comprising a terminal seat, wherein the terminal seat comprises a main body and a plurality of columns parallel with each other and extended from the main body, each terminal is embedded in the main body and extended to longitudinally protrude from an end of the corresponding column, a plurality of channels corresponding to the columns is defined in the tubular body, the main body is accommodated in the handle sleeve, the respective columns are inserted in the respective corresponding channels and the respective terminals are exposed in the tubular body.

* * * * *